United States Patent [19]

Makhobey

[11] 4,091,474

[45] May 30, 1978

[54] FLUSH INTERRUPTING ATTACHMENT FOR TOILET TANKS

[76] Inventor: Walter Makhobey, 3109 E. Caley Ave., Littleton, Colo. 80121

[21] Appl. No.: 698,105

[22] Filed: June 21, 1976

[51] Int. Cl.[2] ..... E03D 1/34; E03D 5/02

[52] U.S. Cl. ..... 4/379; 4/324; 4/465

[58] Field of Search ..... 4/52, 56, 57 P, 57 R, 4/67 P, 67 R, DIG. 1; 137/426; 24/81 CC, 116 R, 135 N; 403/391, 396, 400

[56] References Cited

U.S. PATENT DOCUMENTS

| | | | |
|---|---|---|---|
| 2,290,679 | 7/1942 | Edes | 4/67 A |
| 2,651,532 | 9/1953 | Hobbs | 24/81 CC |
| 3,331,387 | 7/1967 | Walters | 137/426 |
| 3,345,648 | 10/1967 | Rafferty | 4/67 A |
| 3,964,109 | 6/1976 | Street et al. | 4/67 A |
| 4,000,526 | 1/1977 | Biela et al. | 4/67 A X |

*Primary Examiner*—Richard E. Aegerter
*Assistant Examiner*—Stuart S. Levy
*Attorney, Agent, or Firm*—Kyle W. Rost

[57] ABSTRACT

An attachment for interrupting the flushing action of a toilet before the entire volume of water in the toilet tank has exited includes a buoyant member that is connected to the water outlet plug of the toilet tank and acts to close the plug when some but not all of the water in the tank has exited. The buoyant member is connected to the plug and closes the plug by applying its weight to the plug when the member is no longer supported by the water. An adapter allows the buoyant member to act on flapper valves as well as on conventional tank plugs.

4 Claims, 9 Drawing Figures

FLUSH INTERRUPTING ATTACHMENT FOR TOILET TANKS

BACKGROUND OF THE INVENTION

1. Field of the Invention

The invention relates to water saving devices for toilet flush tanks. More specifically, the invention is an adjustable attachment for flush mechanisms that terminates a flush before the entire volume of water in the tank has exited.

2. Description of the Prior Art

Saving water in toilet flush tanks is a matter of current concern in many water short areas of the country, and a variety of devices are known for reducing the volume of each flush. Most popular is a brick placed in the flush tank to displace its volume in water. More elaborate devices include liners for the tank, which likewise displace a volume of water. While these devices accomplish the task of reducing water volume per flush, they also reduce the efficiency of the flush by reducing the weight of water available behind the initial water rushing into the toilet bowl. In addition, bricks and like fillers may interfere with the free operation of the float connected to the water inlet valve.

Another approach often tried is a modified structure for the flushing mechanism, often involving special levers and arms for locking the water outlet plug in predetermined positions. Such modified mechanisms are restricted in use to flush tanks having sufficient space and proper design to receive the new mechanisms. Most modified mechanisms are designed for use with an outlet plug as shown in FIG. 6 and are not adaptable to the more modern flap shown in FIG. 7. Thus, a person wishing to save water by using a prior art device must install a new tank or flushing mechanism, often at prohibitive expense. In addition, complex lever systems are unsatisfactory because of the natural scale that builds on submerged plumbing and can cause malfunction.

SUMMARY OF THE INVENTION

A flush interrupter has a tank or float of adjustable buoyancy and weight and is connected to the tank outlet plug means as an attachment that closes the plug means before the entire volume of tank water has exited during a flush. The invention is applicable to most known flush mechanisms without replacing any part of the existing flush mechanism. An adapter that connects to the chain of flapper valve plug means allows the flush interrupter to operate on flaps. One embodiment of the flush interrupter is a float on a chain that clips to the outlet plug means, and a second embodiment is a sealed tank that is directly attached to the outlet plug means.

An object of the invention is to provide an attachment for flush mechanisms that can be applied to existing mechanisms at modest cost and with minimal effort. While saving water is a popular concept, most people are not willing to spend the price of a new toilet flush tank or new flush mechanism just to save a few gallons of water per flush. This invention is both low in cost and adaptable to almost any existing flush mechanism, and, in addition, the user can install and adjust the invention in a few minutes.

An important object is to provide a simple flush interrupter that can be adapted to the individual characteristics of each flush mechanism and that will operate dependably. The invention is adjustable in its buoyancy and weight so that the user can adjust it to compensate for corrosion on his flush mechanism and for the specific size and characteristics of his tank outlet plug means. In addition, the amount of water delivered per flush is adjustable by changing the position of the interrupter on the tank outlet plug means. The simple design of the invention and the basic concept of delivering weight to prematurely close the tank outlet plug means allow the interrupter to operate without complex mechanism.

Another important object is to allow the toilet tank to deliver its full volume of water whenever desired. The flush interrupter operates automatically whenever the tank is flushed normally, but a user can overcome the invention by holding the flush lever in flush position for an extra second or two, thereby allowing the entire volume of water in the flush tank to flow into the toilet bowl for full flushing action.

A further object is to create a flush interrupter that will not interfere with the operation of parts of the flushing mechanism other than the tank outlet plug means. The two embodiments of the invention revealed below are independent of the water intake valve and its float.

DESCRIPTION OF THE PREFERRED EMBODIMENT

Figure 1:
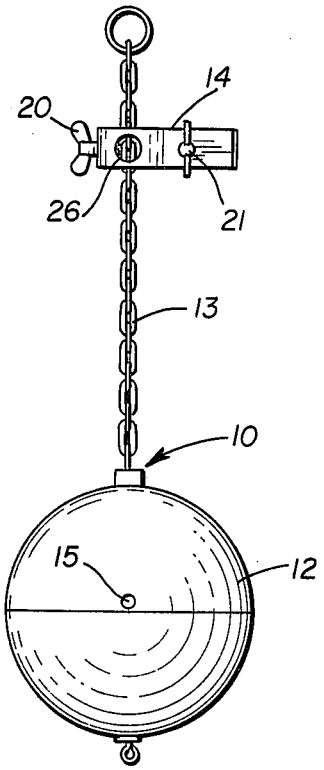
FIG. 1 is an elevational view of one embodiment of the flush interrupter.
Figure 2:
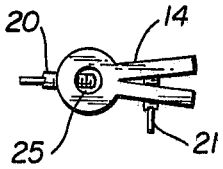
FIG. 2 is a top plan view of the clip shown in FIG. 1.

The flush interrupter 10 is an attachment that may be adapted to fit the flushing mechanism of most known flush tanks and thereby cause the flushing mechanism in the tank to flush the associated toilet with less than a full tank of water. One embodiment of the interrupter includes a weighted float 12 having an attached chain 13 and clip means attached to the chain, for example two way clip 14.

Float 12 is independent of the float ball found on the water inlet valve of many flushing mechanisms. It may be equipped with an aperture 15 that may be sealed with plug means such as a screw. The function of float 12 is to be a weight that returns the water outlet plug means of the flush tank to its seat before the entire volume of water in the tank has emptied through the tank outlet. Aperture 15 allows water or other heavy material to be sealed inside the float by the plug means, thereby allowing float 12 to have adjustable buoyancy for the particular needs of the flushing mechanism with which it is used.

Chain 13 and clip 14 attach float 12 to the outlet plug means of the flush mechanism. Chain 13 is attached at a first end to float 12 and has its second end passing through an opening of clip 14, where it is secured by fastening means, such as screw 20. Clip 14 is secured to the flushing mechanism of a toilet tank by fastening means, such as screw 21. The length of chain between float 12 and clip 14 may be adjusted by loosening screw 20, sliding the chain through clip 14 to the desired length, and retightening screw 20. Clip 14 is designed to attach selectively to either vertical or horizontal edges and may have chain openings 25 and 26 at right angles so that the float and chain will hang vertically as shown in the drawings.

Figure 3:
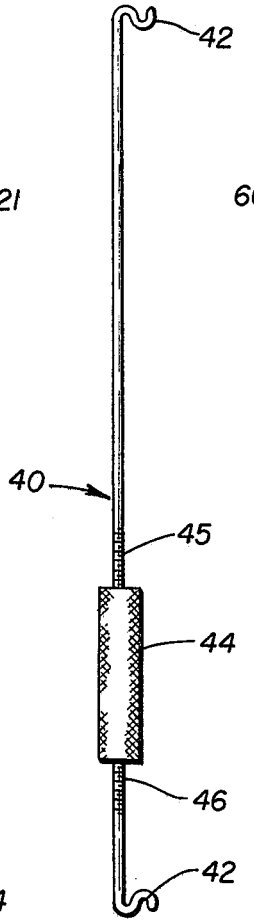
FIG. 3 is an elevational view of an adapter used with the invention.
Figure 6:
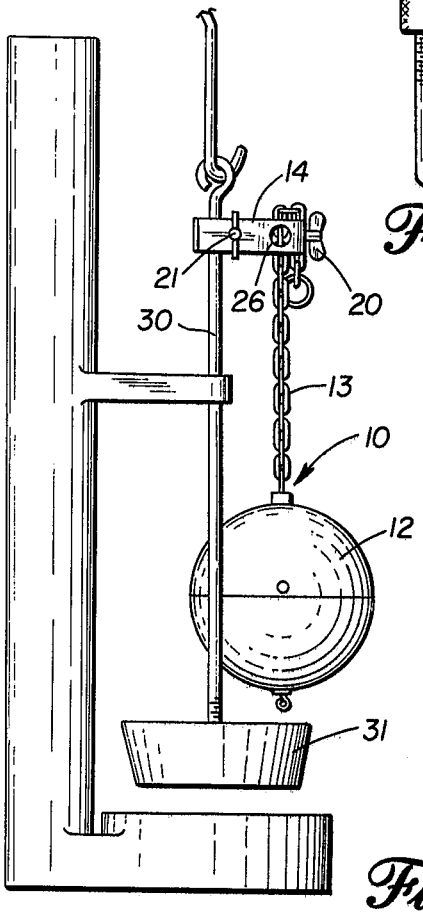
FIG. 6 is an elevational view of one embodiment of the invention attached to the plug means of a toilet tank.
Figure 7:
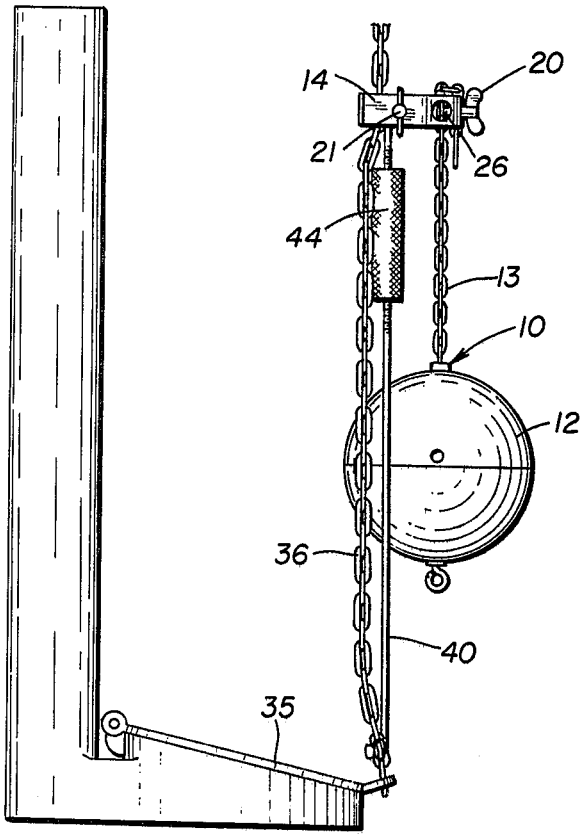
FIG. 7 is a view similar to FIG. 6 showing the invention attached to a flapper valve plug means.
Figure 8:
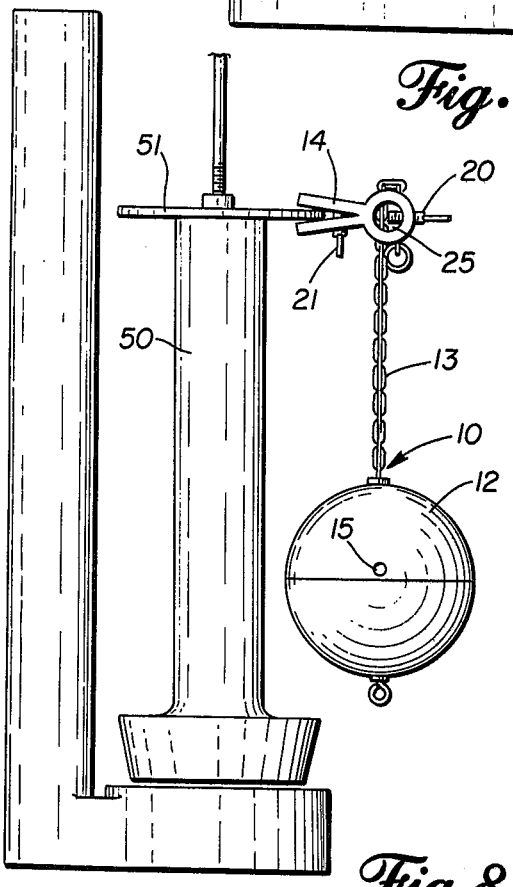
FIG. 8 is a view similar to FIG. 6 showing the invention attached to another variety of plug means.

The method of attaching the flush interrupter 10 to populaar flush mechanisms is shown in FIGS. 6–8. Clip 14 is attached to the wire stem 30 of plug 31 of the mechanism of FIG. 6. Modern flush mechanisms using a flapper valve 35, as shown in FIG. 7, have a chain 36 instead of a wire stem to lift the flap. A special adapter 40 may be installed along the length of chain 36 to provide means along which flush interrupter 10 may act to lower flap 35. As shown in FIG. 3, adapter 40 has chain engaging hooks 42 at both top and bottom ends. Connector 44 has a central threaded bore that receives oppositely threaded inner ends 45 and 46 of adapter 40. By turning connector 44 in a first direction, the ends 45 and 46 are moved together, shortening the length of adapter 40 so that hooks 42 may engage links of chain 36. Connector 44 may then be turned in the opposite direction to lengther adapter 40, firmly securing the adapter to chain 36. Clip 14 of flush interrupter 10 may then be attached directly to adapter 40. Some flush tanks are equipped with a wide stem 50 on the outlet plug o the flush tank, as shown in FIG. 8. Clip 14 may be attached to the upper flange 51 os such plugs.

In operation, float 12 may have its weight adjusted for desired buoyancy on the particular mechanism in the flush tank. For most applications, the float should contain enough air to support its own weight in the tank water and to avoid premature termination of the flushing operation. When the flush is initiated by turning the handle on the tank, the flap 35 or plug 31 or 50, as the case may be, is raised, allowing water to flow from the tank to the toilet bowl below. As the water level drops, the float 12 is lowered until its weight is suspended from chain 13, at which time the weight of the float acts to return flap 35 or plug 31 or 50 to its seat, saving a substantial volume of water. The volume of water used for each flush may be adjusted by changing the length of chain 13 between float 12 and clip 14. If a flush using the entire volume of water in the tank is desired, the mechanism is easily overridden by engaging the flush initiating handle of the tank for an extended period of time, thereby holding the flap or plug out of its seat until the entire volume of tank water has exited.

Figure 4:
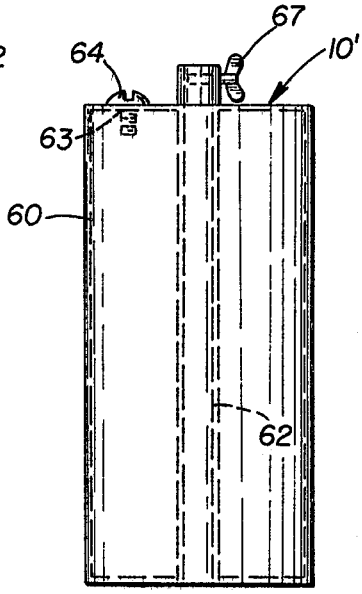
FIG. 4 is an elevational view showing a second embodiment of the invention.
Figure 5:
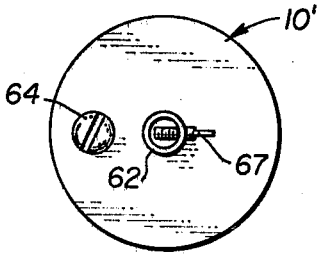
FIG. 5 is a top plan view o the invention shown in FIG. 4.

A second embodiment of the flush interrupter 10′ is shown in FIGS. 4 and 5. This version includes a cylindrical tank 60 having a hollow tube 62 through its center. The tank 60 may have an aperture 63 sealed by a screw 64 or other sealing means, allowing the tank to be partially filled with heavy material to adjust its buoyancy, as was previously described in connection with float 12.

Figure 9:
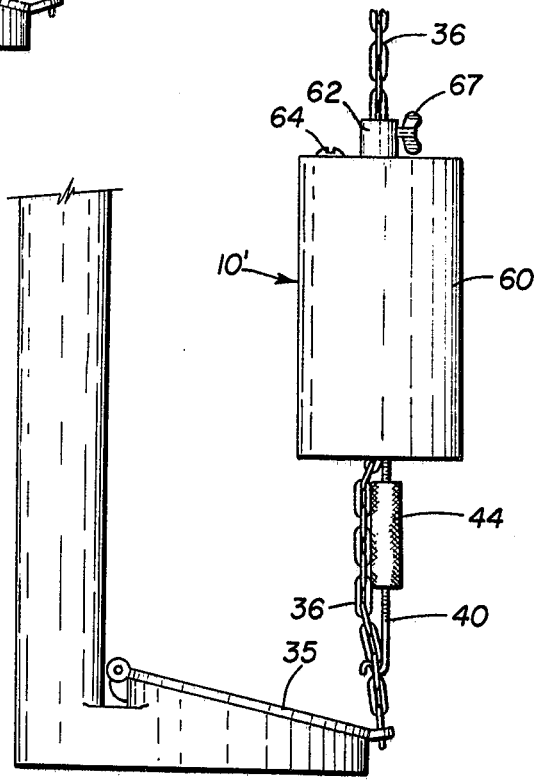
FIG. 9 is a view similar to FIG. 6 showing the second embodiment of the invention attached to a flapper valve plug means.

Flush interrupter 10′ may be attached to any of the previously described flushing mechanisms. Tank 60 may be attached to the wire stem 30 of the mechanism in FIG. 6 by passing a portion of stem 30 through tube 62 and tightening mounting screw 67 against stem 30. As shown in FIG. 9, adapter 40 is used in conjunction with the chain 36 to attach interrupter 10′ to flap 35. A modified version (not shown) having the interrupter 10′ split vertically into two tanks could be applied to stem 50 of FIG. 8 and strapped together. This version would require such modifications as aperture 63 and sealing screw 64 in each of the tanks and the addition of a strap for fastening the halves together.

Preferred materials for the flush interrupter include plastic float 12 or tank 60, brass for screw 64, chain 13, clip 14, and adapter 40. In addition, the strap around the modified version of interrupter 10′ (not shown) may be of brass.

The operation of the flush interrupter allows water from the tank to enter the toilet bowl with the pressure of a full tank of water behind it, giving a vigorous flush but saving the final volume of water, which enters the bowl with low pressure behind it. Because the interrupter is adjustable in buoyancy its characteristics may be adapted to the needs of the individual flush mechanism, and it does not require the presence of the water inlet float or other hardware to aid its operation, other than an outlet plug to which the interrupter may be attached as herein disclosed.

Flush tanks usually deliver 6 gallons of water for each flush, but authorities in many water short areas have suggested that 3 gallons is sufficient for most purposes. Conversion from 6 to 3 gallons is possible by merely adding the flush interrupter to existing flush mechanisms, and the volume of water delivered may be further adjusted by altering the chain length with interrupter 10 or adjusting the mounting height of interrupter 10′. The present invention is believed to be a significant advance in the art both in its adaptability to known flush mechanisms and in its adjustability to individual preferences and requirements.

I claim:

1. A flush interrupting attachment for use in a toilet tank having an independently buoyant plug means normally resting in the seat of a water outlet opening when the toilet is not being flushed but being raised from the seat to allow passage of water when the toilet is being flushed, the plug means lowering to the seat to terminate water passage at a normally predetermined closing level of water in the tank, wherein the invention comprises:

(a) a buoyant member in the toilet tank for applying premature closing force to the plug means before the water level drops to the normally predetermined closing level;

(b) means for adjusting the buoyancy of said buoyant member to apply the required closing force to a plug means; and (c) stiff connecting means attached to said buoyant member and contacting the plug means for transmitting the weight of the buoyant member to the plug means.

2. A flush interrupting attachment for use in a toilet tank having plug means normally resting in the seat of a water outlet opening when the toilet is not being flushed, said plug means being raised from the seat when the toilet is being flushed, wherein said plug means has a chain attached thereto for raising the plug means to initiate a flush, comprising:

(a) a sealed member having adjustable buoyancy located in the toilet tank:

(b) an elongated stiff adapter connecting the sealed member to the plug means, having chain engaging hooks at both ends thereof and having length adjusting means for expanding the distance between said hooks and securing the adapter to the chain, said adapter transmitting the weight of the sealed member to the plug means and urging the plug means into said seat when the water level in the tank drops below the sealed member.

3. The flush interrupting attachment of claim 2, wherein said sealed member has a passageway therein receiving at least a portion of said stiff adapter therethrough.

4. The flush interrupting attachment of claim 2, wherein said sealed member is attached to the stiff adapter by clip means.

* * * * *